US009764295B2

(12) United States Patent
Juan

(10) Patent No.: US 9,764,295 B2
(45) Date of Patent: Sep. 19, 2017

(54) MIXING AND GRINDING MECHANISM AND MIXER GRINDER USING THE SAME

(71) Applicant: CATHAY COATING MANUFACTURE CO., LTD., New Taipei (TW)

(72) Inventor: Kuang-Nan Juan, New Taipei (TW)

(73) Assignee: CATHAY COATING MANUFACTURE CO., LTD., New Taipei (TW)

( * ) Notice: Subject to any disclaimer, the term of this patent is extended or adjusted under 35 U.S.C. 154(b) by 40 days.

(21) Appl. No.: 14/618,275

(22) Filed: Feb. 10, 2015

(65) Prior Publication Data

US 2016/0228835 A1 Aug. 11, 2016

(51) Int. Cl.

| | |
|---|---|
| ***B01F 3/12*** | (2006.01) |
| ***B01F 7/16*** | (2006.01) |
| ***B01F 7/22*** | (2006.01) |
| ***B01F 13/10*** | (2006.01) |

(52) U.S. Cl.

CPC ..... *B01F 3/1221* (2013.01); *B01F 7/161* (2013.01); *B01F 7/22* (2013.01); *B01F 13/1044* (2013.01); *B01F 2013/1086* (2013.01); *B01F 2215/005* (2013.01)

(58) Field of Classification Search

CPC ..... B01F 7/16; B01F 3/04028; B01F 7/005; B01F 7/00525; B01F 7/00841; B01F 9/0016; B01F 13/1044; B01F 15/025; B01F 2015/00603; B01F 2015/00597; B01F 15/00681; B01F 5/0475; B01F 3/1221; B01F 7/14; B02C 15/08; B02C 15/02; B02C 15/04; B02C 15/045; B02C 23/10

USPC .... 241/130, 131, 46.15, 46.74, 74, 84.2, 30, 241/166, 31, 228, 101.8

See application file for complete search history.

(56) References Cited

U.S. PATENT DOCUMENTS

| | | | | |
|---|---|---|---|---|
| 258,027 | A | 5/1882 | Davis, Jr. | |
| 401,306 | A | 4/1889 | Schock et al. | |
| 1,775,345 | A | 9/1930 | Henschel | |
| 1,963,970 | A * | 6/1934 | Cannard | B02C 15/08 241/170 |
| 2,027,297 | A | 1/1936 | Tramposch | |
| 2,137,547 | A | 11/1938 | Snow | |
| 2,636,643 | A | 4/1953 | McCauley | |
| 2,872,122 | A | 2/1959 | Teleky | |
| 3,027,103 | A * | 3/1962 | Mischanski | B02C 15/00 241/131 |
| 3,208,677 | A | 9/1965 | Hesse | |

(Continued)

FOREIGN PATENT DOCUMENTS

| | | | | |
|---|---|---|---|---|
| JP | S60127067 | * | 7/1985 | B22D 13/02 |

*Primary Examiner* — R. K. Arundale
*Assistant Examiner* — Joseph Finan, Jr.
(74) *Attorney, Agent, or Firm* — Pai Patent & Trademark Law Firm; Chao-Chang David Pai

(57) ABSTRACT

A grinding and mixing mechanism for mixing and grinding fluid paint or fluid slurry includes a barrel, a rotor rotatably mounted in the barrel, grinding rolls rotatably mounted in the outer perimeter of the rotor and rotatably kept in contact with the inner barrel wall of the barrel for grinding a fluid paint or slurry, and a stirrer connected to the rotor for synchronous rotation with the rotor to mix the fluid paint or slurry circulated through the barrel. The invention also provides a mixer grinder using the grinding and mixing mechanism.

17 Claims, 9 Drawing Sheets

(56) References Cited

U.S. PATENT DOCUMENTS

| | | | | | |
|---|---|---|---|---|---|
| 3,734,417 | A * | 5/1973 | Russell | A47J 42/38 | 241/168 |
| 4,117,981 | A * | 10/1978 | Engels | B02C 17/161 | 241/172 |
| 4,730,938 | A | 3/1988 | Dunn | | |
| 4,926,390 | A | 5/1990 | Murzsa | | |
| 5,184,783 | A * | 2/1993 | Hockmeyer | B02C 17/168 | 241/172 |
| 5,320,285 | A * | 6/1994 | Lu | B02C 17/16 | 241/46.01 |
| 5,346,147 | A * | 9/1994 | Ishikawa | B02C 17/168 | 241/172 |
| 5,447,372 | A * | 9/1995 | Araki | B01F 7/18 | 366/264 |
| 6,029,915 | A * | 2/2000 | Inoue | B02C 17/168 | 241/17 |
| 6,209,811 | B1 * | 4/2001 | Tippet, Sr. | B01F 3/1221 | 241/131 |
| 6,290,386 | B1 | 9/2001 | Baumgartl et al. | | |
| 7,275,704 | B2 * | 10/2007 | Araki | B01F 3/1221 | 241/172 |
| 7,384,188 | B2 | 6/2008 | Waggoner et al. | | |
| 8,505,842 | B2 * | 8/2013 | Fornasier | B01F 7/00208 | 241/131 |
| 8,616,762 | B2 | 12/2013 | Swader | | |

* cited by examiner

MIXING AND GRINDING MECHANISM AND MIXER GRINDER USING THE SAME

BACKGROUND OF THE INVENTION (a) Field of the Invention

The present invention relates to mixing and grinding technologies, and more particularly to a mixing and grinding mechanism for mixing and grinding fluid paint or other fluid slurry. The invention relates also to a mixer grinder using the mixing and grinding mechanism.

(b) Description of the Prior Art

Various different paints and slurries are known. A paint manufacturing process generally includes: (1) material mixing step to mix pigments, resins, additives, solvents in a mixer; (2) material grinding step to grind the mixed materials into a uniformly distributed status with a roller mill 10 (see FIG. 1) or ball mill machine; (3) adjusting and toning step to adjust the viscosity and color the material thus obtained in step (2) in a mixing barrel 201 of a paint-mixer machine 20 by a stirrer 202 by means of adding different ratios of solvents to the material; and (4) filtering and packing step.

The application of the aforesaid paint manufacturing process and machine arrangement has drawbacks as follows:

(1) The roller mill 10 and the paint-mixer machine 20 are two separate machines. Similar designs of the roller mill 10 can be seen in U.S. Pat. No. 258,027; U.S. Pat. No. 3,208,677; U.S. Pat. No. 2,872,122. Similar designs of the paint-mixer machine 20 can be seen in U.S. Pat. No. 6,290,386; U.S. Pat. No. 2,137,547; U.S. Pat. No. 401,306; U.S. Pat. No. 8,616,762; U.S. Pat. No. 2,027,297; U.S. Pat. No. 4,730,938. Thus, various independent machines need to be installed in the manufacturing line, increasing the manufacturing cost and occupying much factory space.

(2) In the adjusting and toning step, pigments may need to be applied, however, the stirrer 202 of the paint-mixer machine 20 (see FIG. 1) does not provide a grinding function. Similar designs of the structure of the stirrer 202 can be seen in U.S. Pat. No. 7,384,188; U.S. Pat. No. 2,636,643; U.S. Pat. No. 4,926,390; U.S. Pat. No. 1,775,345. According to the aforesaid prior art design, another grinder is needed to grind pigments before they are added to the paint-mixer machine 20, thus complicating the manufacturing process.

(3) After the grinding through the roller mill 10, a part of the material may not have been finely ground, however, in the mixing operation through the paint-mixer machine 20, the material cannot be ground into fine grade.

SUMMARY OF THE INVENTION

The present invention has been accomplished under the circumstances in view. It is therefore the main object of the present invention to provide a grinding and mixing mechanism and a mixer grinder using the grinding and mixing mechanism that can simultaneously perform grinding and mixing works.

To achieve this and other objects of the present invention, a mixer grinder comprises a machine base, an upright post vertically upwardly mounted at the machine base, a suspension arm horizontally mounted on a top end of the upright post above the machine base, a rotating shaft rotatably mounted in a front bottom side of the suspension arm, at least one locating rod fixedly mounted at the front bottom side of the suspension arm around the rotating shaft, a drive motor mounted in the suspension arm and controllable to rotate the rotating shaft, and a grinding and mixing mechanism. The grinding and mixing mechanism comprises a barrel, a rotor, a plurality of grinding rolls, and a stirrer. The barrel is fastened with one end thereof to the at least one locating rod; the barrel comprises an accommodation chamber and an inner barrel wall surrounding the accommodation chamber. The rotor is disposed in the accommodation chamber of the barrel and fastened with one end thereof to the rotating shaft; the rotor comprises at least one roll groove defined in an outer perimeter thereof, and one of the grinding rolls is rotatably mounted in each roll groove and peripherally rotatably kept in contact with the inner barrel wall of the barrel. The stirrer is fastened to one of opposing top and bottom ends of the rotor for synchronous rotation with the rotor upon rotation of the rotating shaft.

By driving the rotating shaft to rotate the rotor and the stirrer, the grinding roll is rotated over the inner barrel wall of the barrel to grind the fluid paint of slurry therein. At the same time, the stirrer is synchronously rotated to mix and propel the fluid paint or slurry, forcing the fluid paint or slurry to circulate through the accommodation chamber of the barrel. Thus, the invention achieves the effects of: (1) one machine provides two functions (2 in 1), i.e., a mixer and a grinder are integrated into one unit, saving the cost and reducing working space; (2) when mixing and grinding a fluid paint or slurry, other materials can be added for mixing and grinding when desired.

DETAILED DESCRIPTION OF THE PREFERRED EMBODIMENTS

Figure 1:
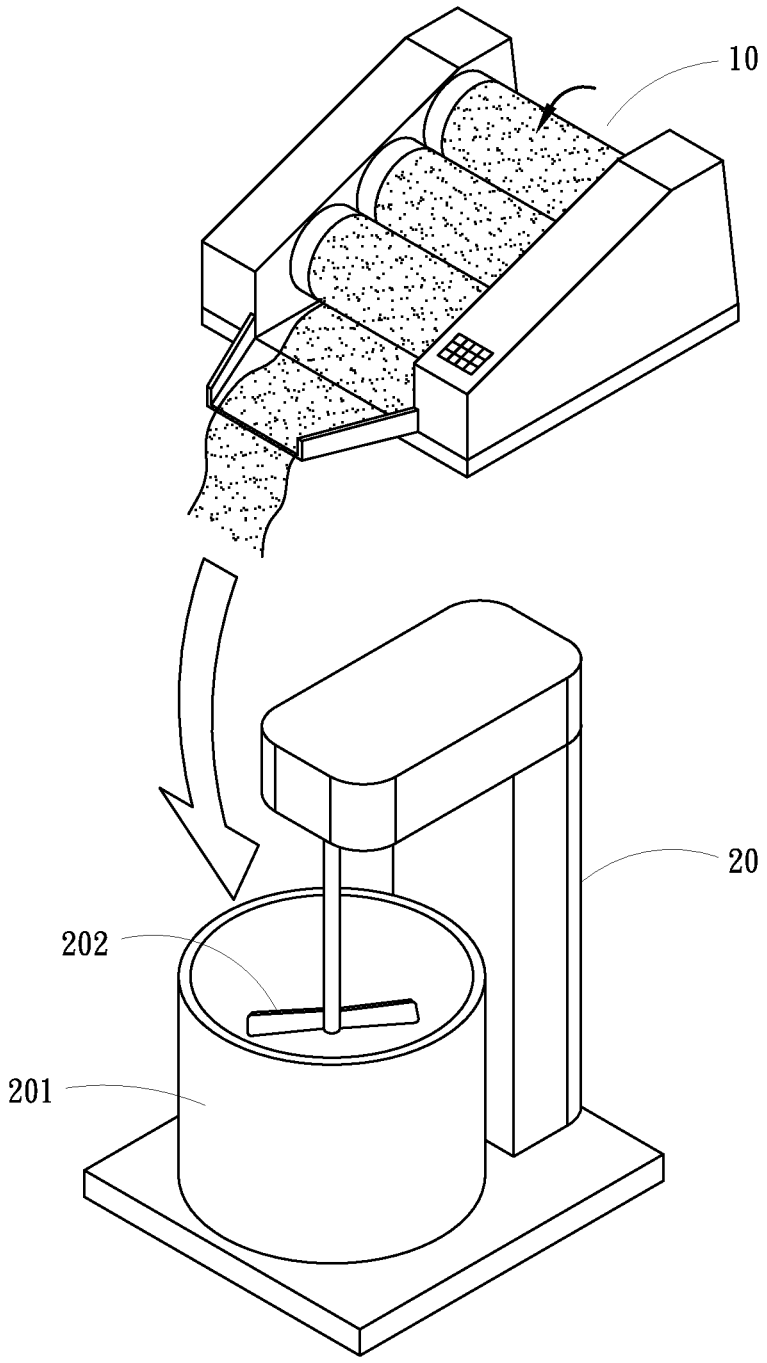
FIG. 1 (Prior Art)
FIG. 1 is a schematic drawing illustrating a roller mill and a pain mixer used in a manufacturing flow according to the prior art.
Figure 2:
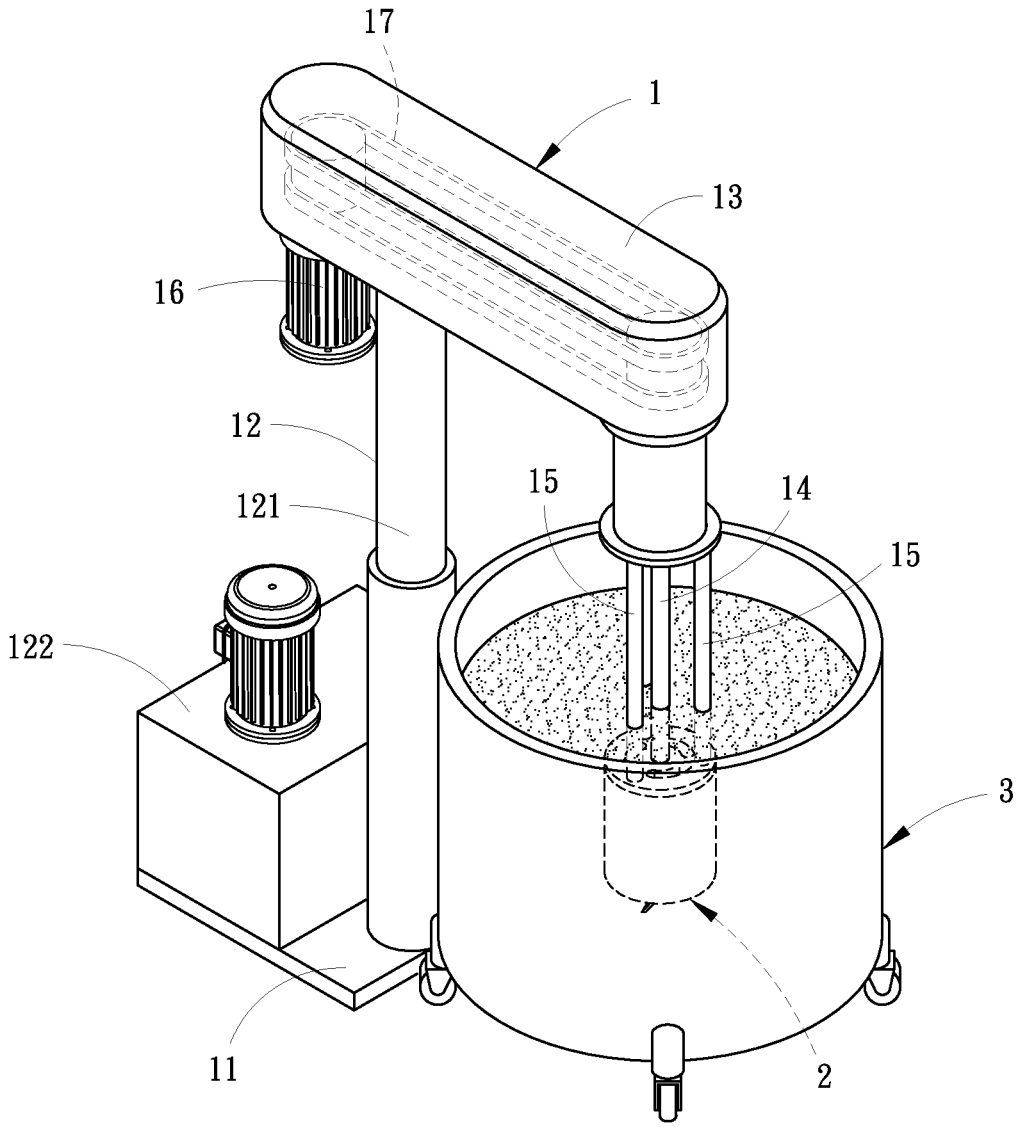
FIG. 2 is a perspective view of a mixer grinder in accordance with the present invention.

Referring to FIG. 2, a mixer grinder 1 in accordance with the present invention is shown for mixing and grinding a fluid paint or fluid slurry. The mixer grinder 1 generally comprises a machine base 11, an upright post 12 vertically upwardly located at the machine base 11, a suspension arm 13 horizontally mounted at a top end of the upright post 12 above the machine base 11, a rotating shaft 14 rotatably mounted in a front bottom side of the suspension arm 13, at least one, for example, a plurality of locating rods 15 fixedly mounted at the front bottom side of the suspension arm 13 around the rotating shaft 14, a drive motor 16 fixedly mounted at a front end (or rear end) of the suspension arm 13, and a grinding and mixing mechanism 2 connected to the locating rods 15 and rotatable by the rotating shaft 14 to mix and grind a fluid paint or fluid slurry in a container 3. The drive motor 16 can be configured to rotate the rotating shaft 14 directly. In this embodiment, the drive motor 16 is configured to rotate the rotating shaft 14 through a transmission mechanism 17.

The aforesaid upright post 12 is preferably a hydraulic retractable bar 121. Further, a hydraulic equipment 122 is mounted at the machine base 11. The hydraulic retractable bar 121 has the fixed end thereof fastened to the machine base 11 and the movable end thereof connected to the suspension arm 13. Thus, the hydraulic retractable bar 121 can be moved by the hydraulic equipment 122 to adjust the elevation of the suspension arm 13 and the grinding and mixing mechanism 2 to fit the container 3 and to allow the container 3 to be moved in and out. The aforesaid transmission mechanism 17 can be a belt transmission mechanism or a gear transmission mechanism mounted in the suspension arm 13 and drivable by the drive motor 16 to rotate the rotating shaft 14.

Figure 3:
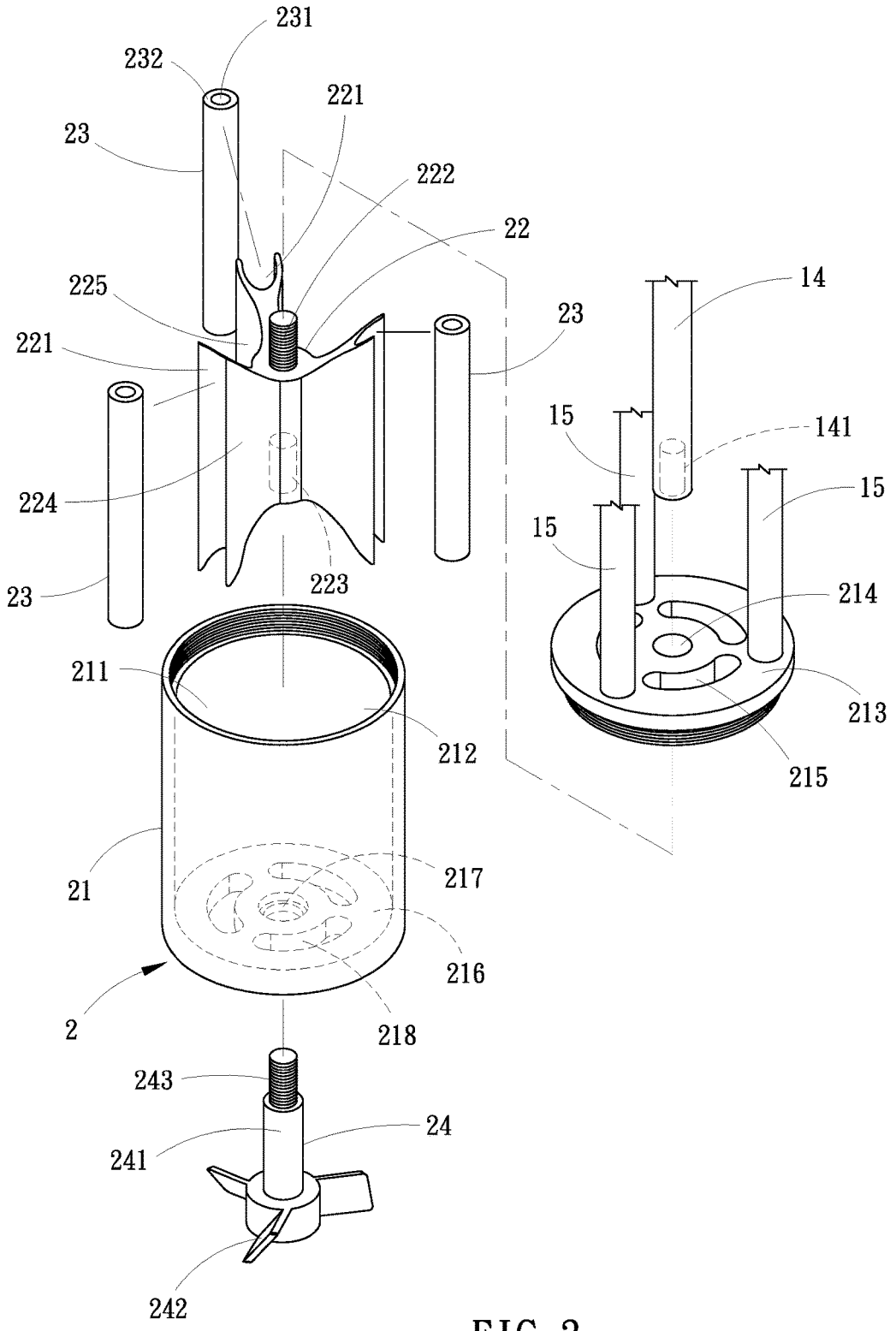
FIG. 3 is an exploded view of the grinding and mixing mechanism of the mixer grinder in accordance with the present invention.
Figure 4:
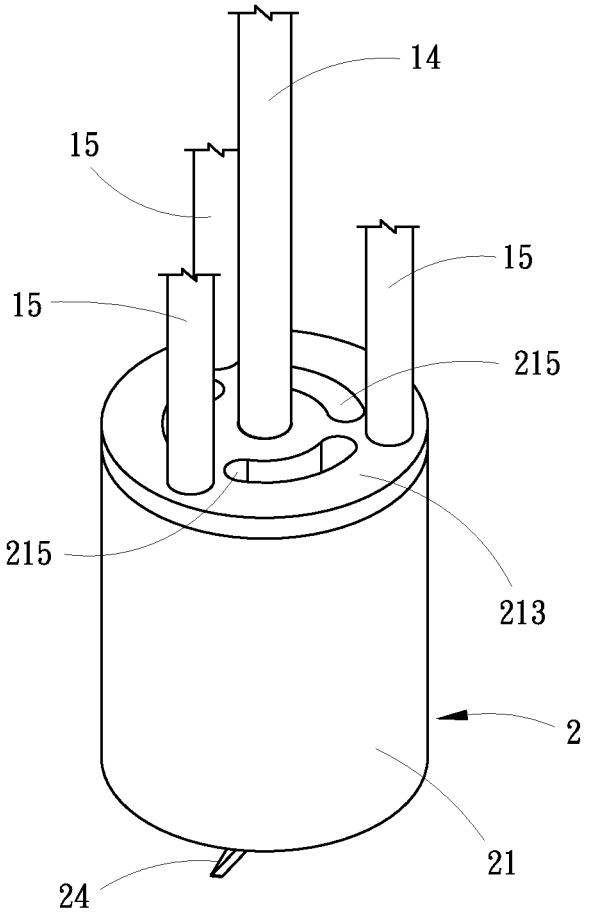
FIG. 4 is an elevational assembly view of the grinding and mixing mechanism shown in FIG. 3.
Figure 5:
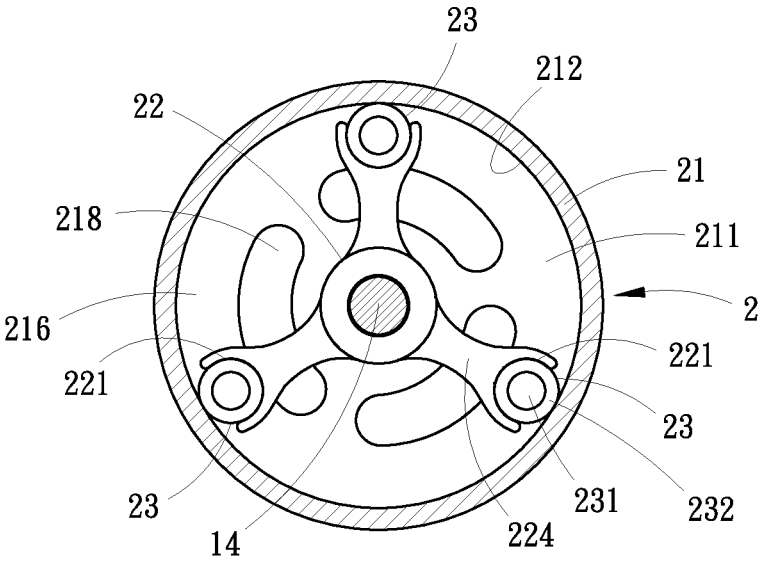
FIG. 5 is a cross-sectional view of the grinding and mixing mechanism shown in FIG. 4.

Referring to FIG. 3, FIG. 4 and FIG. 5, the grinding and mixing mechanism 2 preferably comprises a barrel 21, a rotor 22, a plurality of grinding rolls 23, and a stirrer 24. The barrel 21 is a hollow member having, for example, a cylindrical shape, comprising an accommodation chamber 211 and a cylindrical inner barrel wall 212 surrounding the accommodation chamber 211. The rotor 22 is rotatably mounted in the accommodation chamber 211 of the barrel 21 and connected with a top end thereof to the rotating shaft 14 for synchronous rotation, comprising at least one, for example, a plurality of equiangularly spaced roll grooves 221 that are straight grooves disposed in parallel to the inner barrel wall 212. The grinding rolls 23 are respectively rotatably mounted in the roll grooves 221 of the rotor 22. Each grinding roll 23 comprises a metal roll body 231 shaped like a round rod, and a ceramic coating 232 covering the periphery of the metal roll body 231 and kept in direct contact with the inner barrel wall 212 of the barrel 21. During rotation of the rotor 22, the grinding rolls 23 are rotated to move the respective ceramic coating 232 over the inner barrel wall 212 of the barrel 21 to grind the fluid paint or slurry being guided into the accommodation chamber 211. The stirrer 24 can be connected to the top or bottom end of the rotor 22 for synchronous rotation with the rotor 22 to mix the applied fluid paint or slurry by means of the blades thereof (this will be described further.

Figure 6:
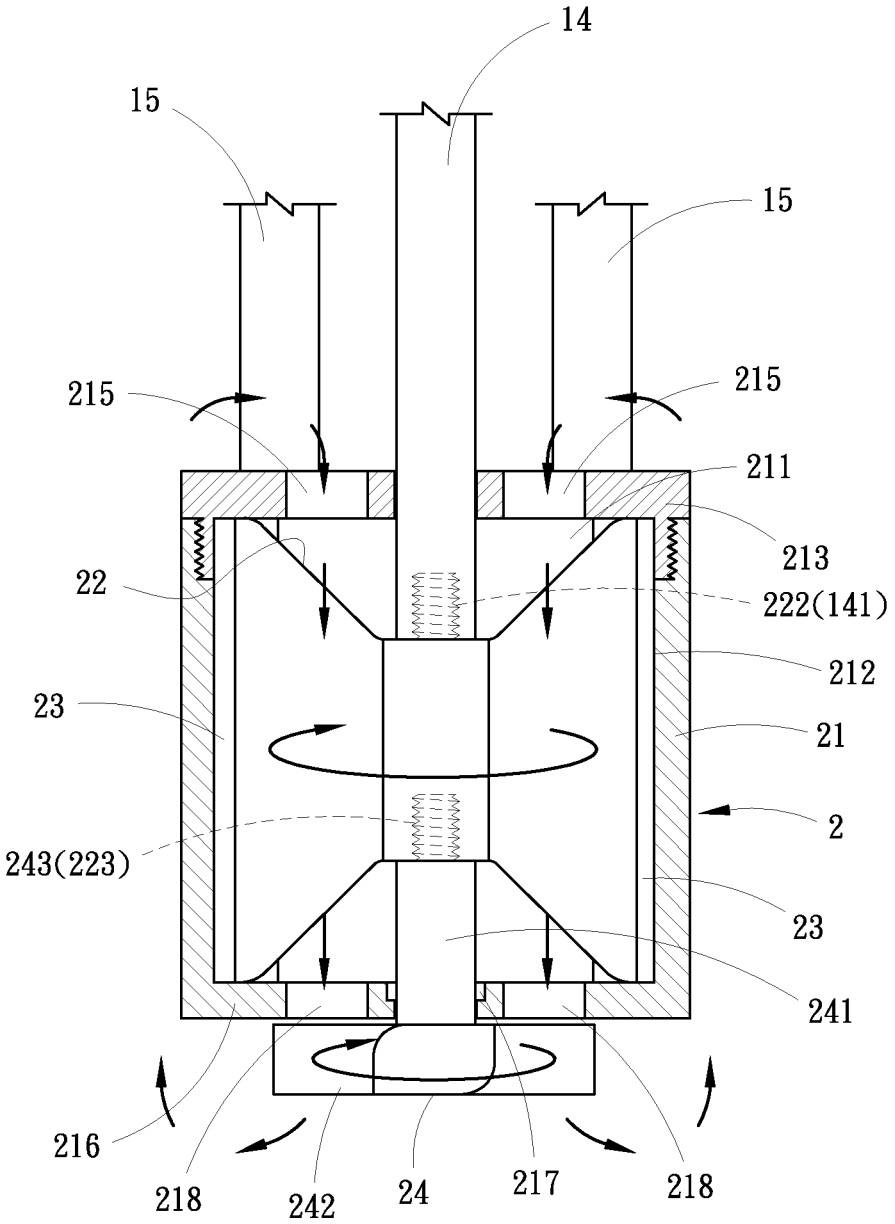
FIG. 6 is a schematic drawing illustrating an operation status of the grinding and mixing mechanism in accordance with the present invention.

Referring to FIG. 6, and FIG. 3 again, the aforesaid barrel 21 is preferably a hollow upright barrel, comprising a top cover 213 for covering a top side of the accommodation chamber 211. The top cover 213 comprises an upper axle hole 214 located in the center thereof, and a plurality of upper fluid slots 215 equiangularly spaced around the upper axle hole 214. The rotating shaft 14 is inserted through the upper axle hole 214 and connected to a top end of the rotor 22. The inner barrel wall 212 is preferably configured to provide an inner thread in a top end thereof; the top cover 213 is preferably configured to provide an outer thread at a bottom end thereof for threading into the inner thread of the inner barrel wall 212 to secure top cover 213 to the top end of the barrel 21. The connection structure between the rotor 22 and the rotating shaft 14 is preferably configured to provide a screw rod 222 at the top end of the rotor 22 and a screw hole 141 in the bottom end of the rotating shaft 14 for threading onto the screw rod 222. However, it is to be noted that the connection structure between the rotor 22 and the rotating shaft 14 is not limited to the aforesaid screw joint, other design can be employed to the rotor 22 and the rotating shaft 14 together.

Referring to FIG. 3 and FIG. 6 again, the barrel 21 further comprises a bottom wall 216 closing an opposing bottom side of the accommodation chamber 211, a bottom axle hole 217 located in the center of the bottom wall 216, and a plurality of bottom fluid slots 218 cut through the bottom wall 216 and equiangularly spaced around the bottom axle hole 217. In this embodiment, the stirrer 24 is disposed below the barrel 21, comprising a shank 241, and a plurality of stirring blades 242 radially connected to and equiangularly spaced around one end of the shank 241. An opposite end of the shank 241 is inserted through the bottom axle hole 217 of the bottom wall 216 and connected to the rotor 22. Preferably, the bottom wall 216 is formed integral with the barrel 21. Preferably, the shank 241 of the stirrer 24 is configured to provide a screw rod 243, the rotor 22 is configured to provide screw hole 223 that is threaded onto the screw rod 243.

According to the aforesaid design, as shown in FIG. 2, the barrel 21 of the grinding and mixing mechanism 2 is fixedly connected to the locating rods 15 of the mixer grinder 1. When using the mixer grinder 1 to mix and grind a material, for example, fluid paint, as shown in FIG. 5 and FIG. 6, the rotating shaft 14 is driven by the drive motor to rotate the rotor 22. During rotation of the rotor 22, the grinding rolls 23 are rotated to move over the inner barrel wall 212 of the barrel 21, and at the same time, the stirring blades 242 of the stirrer 24 are moved to stir up the fluid paint, forcing the fluid paint to flow through the upper fluid slots 215 of the top cover 213 into the accommodation chamber 211. The fluid paint in the accommodation chamber 211 is then ground between the grinding rolls 23 and the inner barrel wall 212, and then guided out of the barrel 21 through the bottom fluid slots 218, and then stirred up by the stirrer 24 again, and thus, the invention simultaneously achieve grinding and mixing functions.

Figure 7:
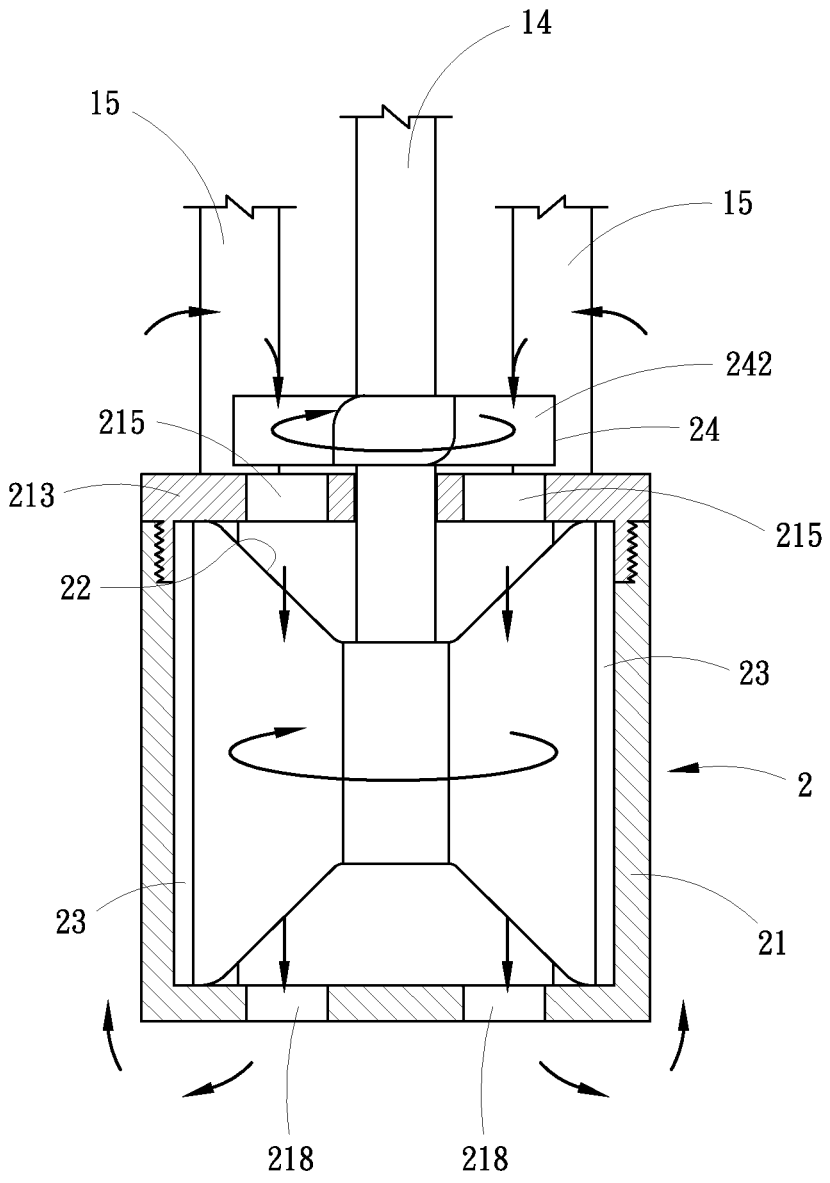
FIG. 7 is a schematic drawing of an alternate form of the grinding and mixing mechanism in accordance with the present invention, illustrating the stirrer disposed above the barrel.

The stirrer 24 provides the function of mixing the fluid paint and the function of propelling the fluid paint to circulate through the accommodation chamber 211. The mounting location of the stirrer 24 is not restricted to the bottom side of the barrel 1. In an alternate form of the present invention, as shown in FIG. 7, the stirrer 24 is configured to provide at least one stirring blade 242 that is disposed at the top side of the barrel 21 and coupled to the rotating shaft 14. Thus, the rotating shaft 14 can be driven to rotate the stirrer 24, propelling the applied fluid paint to repeatedly flow into the barrel 21 through the upper fluid slots 215 and then out of the barrel 21 through the bottom fluid slots 218.

Figure 8:
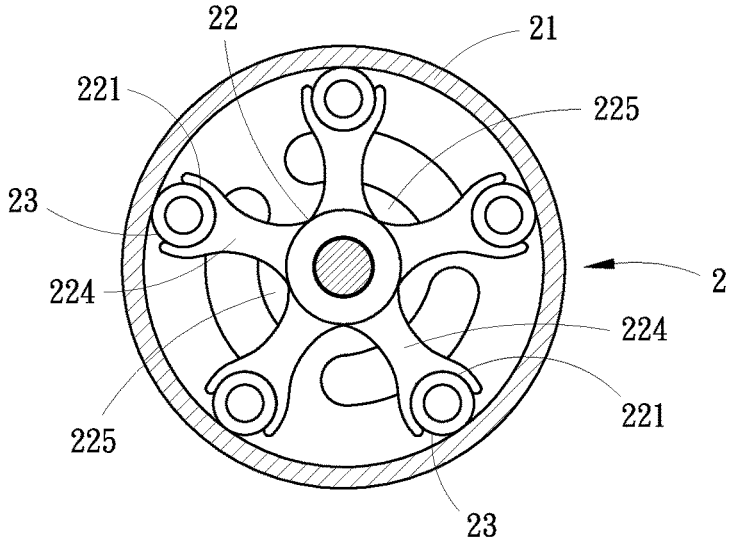
FIG. 8 is a cross-sectional view illustrating an alternate form of the rotor in accordance with the present invention.

Referring to FIG. 8, and FIG. 3 and FIG. 5 again, the rotor 22 comprises a plurality of rotor arms 224, and a flow space 225 defined between each two adjacent rotor arms 224. The number of the rotor arms 224 can be 2, 3, 4 or 5. Each rotor arm 224 has one roll groove 221 defined in a distal end thereof for accommodating one respective grinding roll 23.

The design of the flow spaces 225 allow the applied fluid paint to circulate through the accommodation chamber 211 of the barrel 21.

Figure 9:
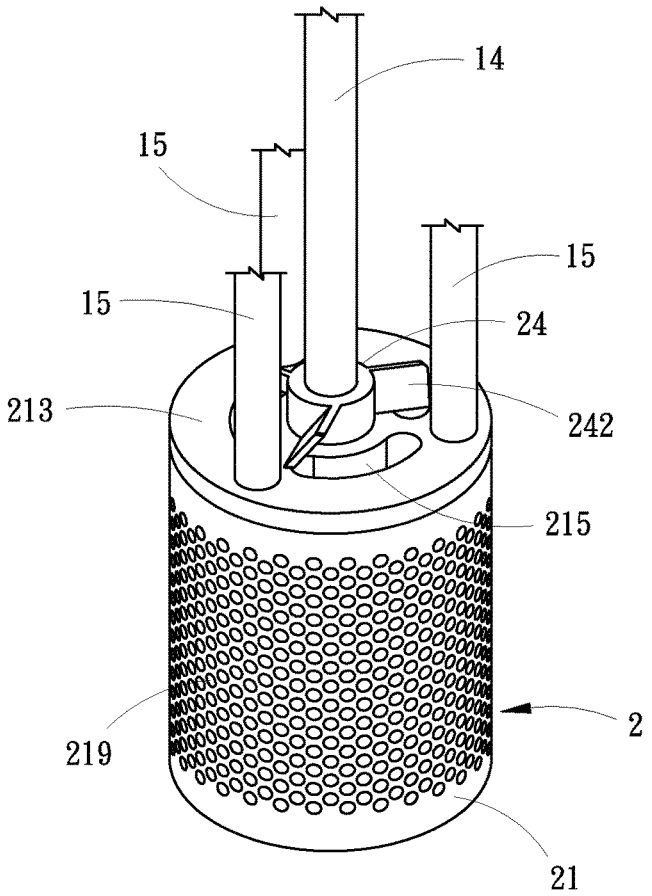
FIG. 9 is an oblique top elevational view, illustrating the barrel provided with perforations in the periphery thereof in accordance with the present invention.
Figure 10:
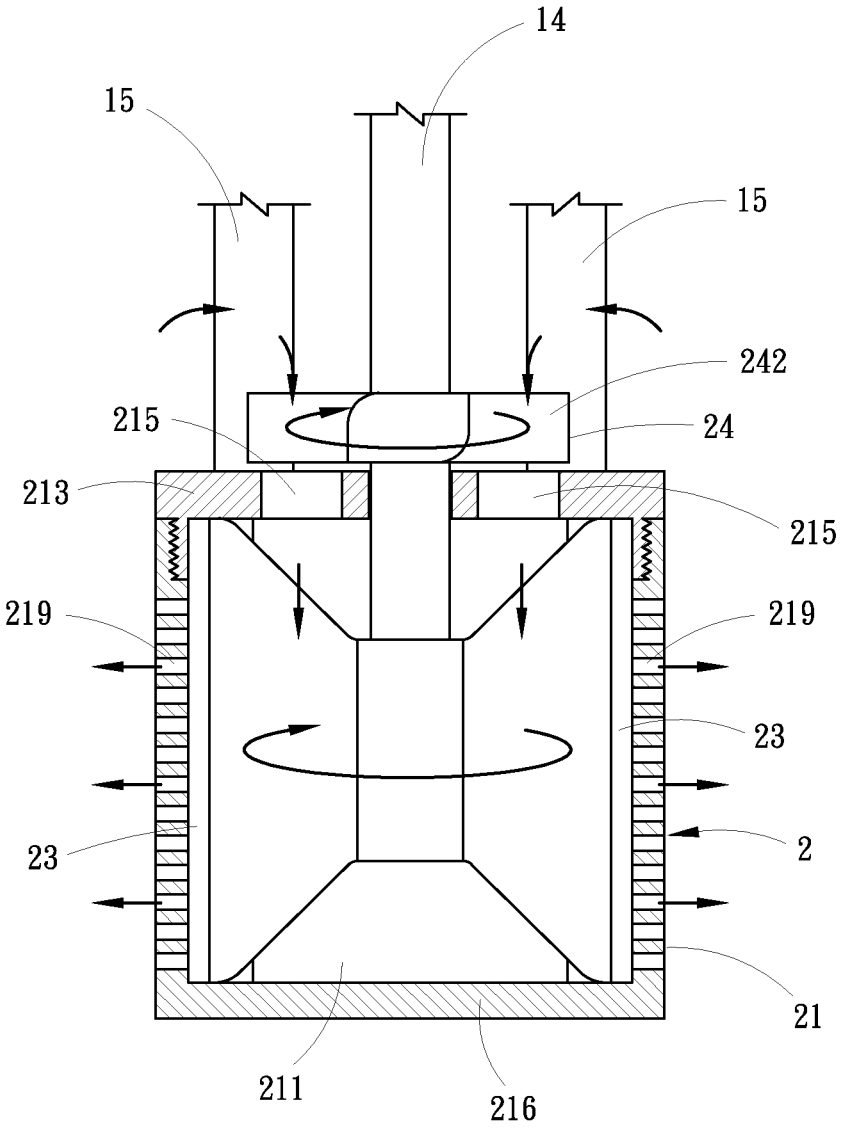
FIG. 10 is a schematic drawing illustrating the applied fluid paint being circulated through the perforations of the barrel in accordance with the present invention.
Figure 11:
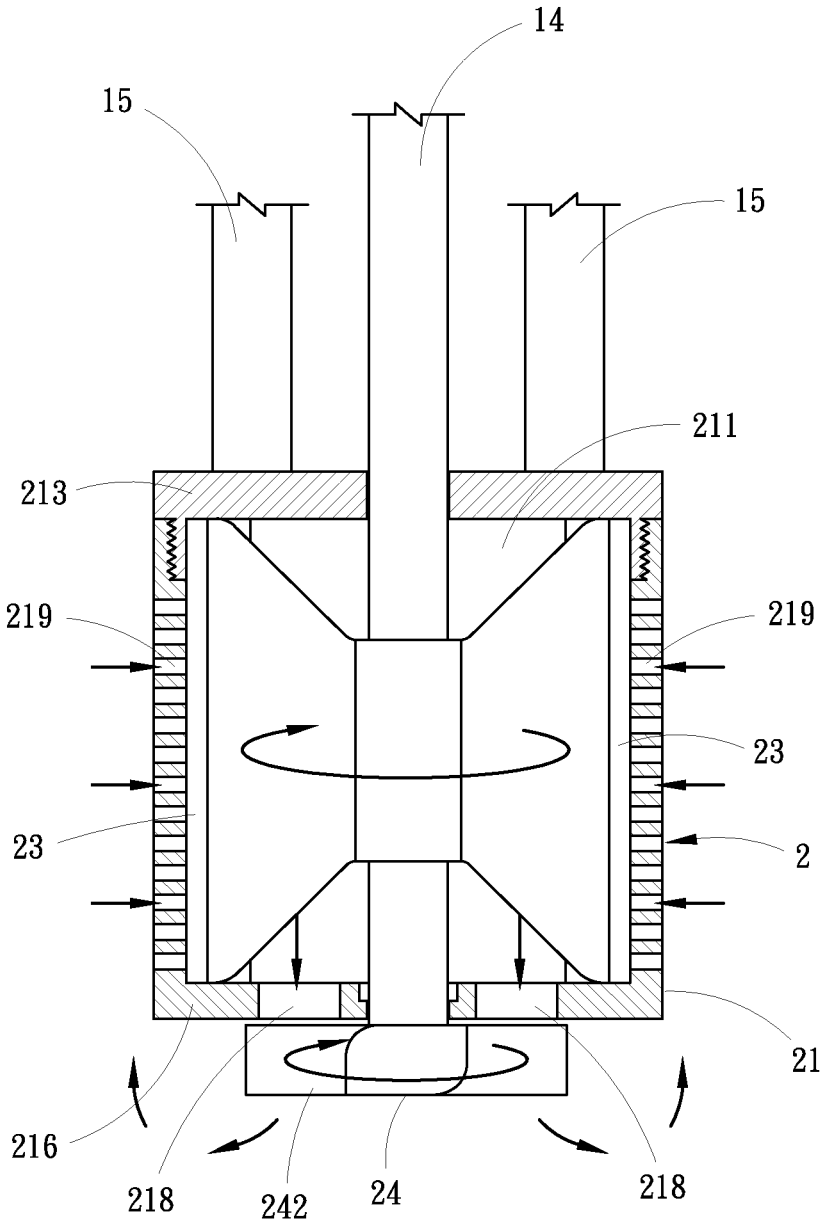
FIG. 11 is a schematic drawing illustrating the circulating direction of the applied fluid paint through the perforations and bottom fluid slots of the barrel in accordance with the present invention.

Further, as shown in FIG. 9 and FIG. 10, the barrel 21 can be configured to provide a plurality of perforations 219 in the periphery thereof in communication between the accommodation chamber 211 and the space outside the barrel 21 for allowing circulation of the applied fluid paint. Further, if the stirrer 24 is mounted on the rotating shaft 14 above the barrel 21, the bottom wall 216 of the barrel 21 can be a completely closed structure without the aforesaid bottom fluid slots 218. Thus, the applied fluid paint can be propelled through the upper fluid slots 215 into the accommodation chamber 211 to be ground therein and forced out of the accommodation chamber 211 through the perforations 219, and then repeatedly circulated through the barrel 21 in the same manner. Further, as shown in FIG. 11, if the stirrer 24 is disposed below the barrel 21, the top cover 213 of the barrel 21 can be configured without the upper fluid slots 215, and the perforations 219 and the bottom fluid slots 218 in the bottom wall 216 remain unchanged. Thus, when the stirrer 24 is rotated, the applied fluid paint is guided through the perforations 219 into the accommodation chamber 211 to be ground therein by the grinding rolls 23, and then propelled out of the accommodation chamber 211 through the bottom fluid slots 218.

What is claimed is:

1. A mixer grinder for mixing and grinding fluid paint or fluid slurry, comprising:

a machine base; an upright post mounted at said machine base;

a suspension arm horizontally mounted on a top end of said upright post above said machine base;

a rotating shaft rotatably mounted in a front bottom side of said suspension arm;

at least one locating rod fixedly mounted at the front bottom side of said suspension arm;

a drive motor mounted to said suspension arm and controllable to rotate said rotating shaft; and a grinding and mixing mechanism comprising a barrel fastened with one end thereof to said at least one locating rod, said barrel comprising an accommodation chamber and an inner barrel wall surrounding said accommodation chamber; a rotor disposed in said accommodation chamber of said barrel and fastened with one end thereof to said rotating shaft, said rotor comprising a plurality of rotor arms, and a roll groove defined in an outer perimeter of each of the plurality of rotor arms; a round cylindrical grinding roll rotatably positioned in each said roll groove and peripherally rotatably kept in contact with said inner barrel wall of said barrel; and a stirrer fastened to one of opposing top and bottom ends of said rotor for synchronous rotation with said rotor upon rotation of said rotating shaft, wherein an open space is formed between each two adjacent rotor arms allowing fluids to flow therethrough, and each said roll groove extends parallel to the inner barrel wall and has a surface corresponding to an outer surface of the associated grinding roll such that the grinding roll is rotatably positioned between the roll groove and the inner barrel wall, wherein said rotor has a cylindrical center portion coaxial with said rotating shaft; and each said rotor arm has a trapezoidal side elevation with a shorter base joined with and parallel to said center portion, one upper side extending upwards from said center portion towards the outer perimeter of the rotor arm, and one lower side extending downwards from said center portion towards the outer perimeter of the rotor arm.

2. The mixer grinder as claimed in claim 1, wherein said upright post is a hydraulic retractable bar, said hydraulic retractable bar comprising a fixed end affixed to said machine base and an opposing movable end affixed to said suspension arm.

3. The mixer grinder as claimed in claim 1, further comprising a transmission mechanism mounted in said suspension arm and coupled between said drive motor and said rotating shaft.

4. The mixer grinder as claimed in claim 1, wherein said barrel further comprises a top cover covering a top side of said accommodation chamber, said top cover comprising an upper axle hole for the rotating shaft to pass through to connect to said rotor, wherein the inner barrel wall has an inner thread and the top cover has an outer thread for threading into the inner thread of the inner barrel wall to secure the top cover to the barrel.

5. The mixer grinder as claimed in claim 4, wherein said barrel further comprises a bottom wall covering an opposing bottom side of said accommodation chamber, said bottom wall comprising a bottom axle hole; said stirrer is disposed below said barrel and comprises a shank inserted through said bottom axle hole and connected to said rotor and at least one stirring blade radially connected to one end of said shank outside said barrel.

6. A grinding and mixing mechanism for mixing and grinding fluid paint or fluid slurry, comprising:

a barrel comprising an accommodation chamber and an inner barrel wall surrounding said accommodation chamber;

a rotor rotatably disposed in said accommodation chamber of said barrel and fixedly connected to an external rotating shaft, said rotor comprising a plurality of rotor arms and a roll groove defined in an outer perimeter of each of the plurality of rotor arms;

a round cylindrical grinding roll rotatably positioned in each said roll groove and peripherally rotatably kept in contact with said inner barrel wall of said barrel; and a stirrer fastened to one of opposing top and bottom ends of said rotor for synchronous rotation with said rotor, wherein an open space is formed between each two adjacent rotor arms allowing fluids to flow therethrough, and each said roll groove extends parallel to the inner barrel wall and has a surface corresponding to an outer surface of the associated grinding roll such that the grinding roll is rotatably positioned between the roll groove and the inner barrel wall, wherein said rotor has a cylindrical center portion coaxial with said rotating shaft; and each said rotor arm has a trapezoidal side elevation with a shorter base joined with and parallel to said center portion, one upper side extending upwards from said center portion towards the outer perimeter of the rotor arm, and one lower side extending downwards from said center portion towards the outer perimeter of the rotor arm.

7. The grinding and mixing mechanism as claimed in claim 6, wherein each said grinding roll comprises a metal roll body and a ceramic coating covering a periphery of the metal roll body.

8. The grinding and mixing mechanism as claimed in claim 7, wherein said barrel further comprises a plurality of perforations located in the periphery thereof in communication between said accommodation chamber and the space outside said barrel.

9. The grinding and mixing mechanism as claimed in claim 7, wherein said top cover further comprises at least one upper fluid slot cut through opposing top and bottom surfaces thereof.

10. The grinding and mixing mechanism as claimed in claim 7, wherein said bottom wall further comprises at least one bottom fluid slot cut through opposing top and bottom surfaces thereof.

11. The grinding and mixing mechanism as claimed in claim 6, wherein said barrel further comprises a top cover covering a top side of said accommodation chamber, said top cover comprising an upper axle hole for the external rotating shaft to pass through to connect to said rotor, wherein the inner barrel wall has an inner thread and the top cover has an outer thread for threading into the inner thread of the inner barrel wall to secure the top cover to the barrel.

12. The grinding and mixing mechanism as claimed in claim 11, wherein said barrel further comprises a plurality of perforations located in the periphery thereof in communication between said accommodation chamber and the space outside said barrel.

13. The grinding and mixing mechanism as claimed in claim 11, wherein said top cover further comprises at least one upper fluid slot cut through opposing top and bottom surfaces thereof.

14. The grinding and mixing mechanism as claimed in claim 11, wherein said barrel further comprises a bottom wall covering an opposing bottom side of said accommodation chamber, said bottom wall comprising a bottom axle hole; said stirrer is disposed below said barrel and comprises a shank inserted through said bottom axle hole and connected to said rotor and at least one stirring blade radially connected to one end of said shank outside said barrel.

15. The grinding and mixing mechanism as claimed in claim 14, wherein said barrel further comprises a plurality of perforations located in the periphery thereof in communication between said accommodation chamber and the space outside said barrel.

16. The grinding and mixing mechanism as claimed in claim 14, wherein said top cover further comprises at least one upper fluid slot cut through opposing top and bottom surfaces thereof.

17. The grinding and mixing mechanism as claimed in claim 14, wherein said bottom wall further comprises at least one bottom fluid slot cut through opposing top and bottom surfaces thereof.

* * * * *